US006619436B1

(12) United States Patent
Hikita

(10) Patent No.: US 6,619,436 B1
(45) Date of Patent: Sep. 16, 2003

(54) ELEVATOR GROUP MANAGEMENT AND CONTROL APPARATUS USING RULE-BASED OPERATION CONTROL

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/869,689

(22) PCT Filed: Mar. 29, 2000

(86) PCT No.: PCT/JP00/01964

§ 371 (c)(1),
(2), (4) Date: Jul. 3, 2001

(87) PCT Pub. No.: WO01/72622

PCT Pub. Date: Oct. 4, 2001

(51) Int. Cl.[7] ..... B66B 1/18
(52) U.S. Cl. ..... 187/382; 187/247
(58) Field of Search ..... 187/380, 382, 187/385, 386, 387, 247, 391, 393; 706/23, 45, 47

(56) References Cited

U.S. PATENT DOCUMENTS 4,355,705 A * 10/1982 Schroder et al. ..... 187/387
5,229,559 A * 7/1993 Siikonen et al. ..... 187/391
5,233,138 A * 8/1993 Amano ..... 187/382
5,808,247 A * 9/1998 Thangavelu ..... 187/386
5,923,004 A * 7/1999 Whitehall et al. ..... 187/382
6,394,232 B1 * 5/2002 Iwata et al. ..... 187/382
6,493,691 B1 * 12/2002 Neuneier et al. ..... 706/45

FOREIGN PATENT DOCUMENTS

| | | |
|---|---|---|
| GB | 2 293 365 | 3/1996 |
| JP | 58-59178 A | 4/1983 |
| JP | 1-261176 | 10/1989 |
| JP | 4-235869 | 8/1992 |
| JP | 6-13390 B2 | 2/1994 |
| JP | 6-156893 A | 6/1994 |
| JP | 8-85682 | 4/1996 |

* cited by examiner

*Primary Examiner*—Jonathan Salata
(74) *Attorney, Agent, or Firm*—Leydig, Voit & Mayer, Ltd.

(57) ABSTRACT

An elevator group management and control apparatus that manages and controls elevators as one group, detects the traffic demands of the elevators in a building; predicts the traffic demand in the near future on the basis of the detected traffic demand; discriminates the traffic pattern of the near future in accordance with the predicted result of the traffic demand; automatically generates candidates from the group management and control rule groups to be applied in the near future on the basis of the traffic pattern which has been predicted and discriminated; evaluates and selects one candidate of the respective rule groups which have been generated; and controls the elevators using the selected rule group, to implement group management and control, always using an appropriate rule group.

5 Claims, 6 Drawing Sheets

FIG. 4

FIXED RULE

DUMPLING OPERATION PREVENTION RULE 1 : FOR UPSTAIRS

IF (CALL OCCURS IN UPPER FLOORS)
and (THERE ARE MANY CARS THAT ARE MOVING TOWARD UPPER FLOORS)
THEN (CARS THAT ARE MOVING TOWARD UPPER FLOORS ARE CHOSEN AS ALLOCATION CANDIDATES)

DUMPLING OPERATION PREVENTION RULE 2 : FOR MIDDLE STAIRS

IF (CALL OCCURS IN MIDDLE FLOORS)
...

...

COMPREHENSIVE EVALUATION RULE :

IF (THERE ARE A PLURALITY OF ALLOCATION CANDIDATES)
THEN (SELECT CARS TO BE ALLOCATED THROUGH COMPREHENSIVE EVALUATION EXPRESSION f(x)

---

VARIABLE RULE

MAIN FLOOR WAITING RULE :

IF (THERE IS NO CAR AT MAIN FLOOR OR NO CAR WAITS FOR A CALL)
THEN (ONE CAR IS ALLOCATED AT MAIN FLOOR AND ALLOWED TO WAIT)

---

PARAMETER RULE

LONG WAITING PREVENTION RULE :

IF (THERE IS A CAR THAT CANNOT BE CALLED FOR LONG WAITING IF ALLOCATED)
THEN (A CAR THAT CANNOT BE CALLED FOR LONG WAITING IS ALLOCATED AS CANDIDATE)
ELSE IF (ALL CARS CAN BE CALLED FOR LONG WAITING IF ALLOCATED)
THEN (SELECT A CAR WITH THE SHORTEST MAXIMUM LONG WAITING TIME)

DEFINITION OF LONG WAITING : CALL WHERE WAITING TIME IS EQUAL TO OR LONGER THAN LIMIT VALUE T SECONDS
T=30SECONDS,45SECONDS,60SECONDS, 75SECONDS,···

ELEVATOR GROUP MANAGEMENT AND CONTROL APPARATUS USING RULE-BASED OPERATION CONTROL

TECHNICAL FIELD

The present invention relates to an elevator group management and control apparatus that efficiently manages and controls a plurality of elevators.

BACKGROUND ART

Usually, in a building in which a plurality of elevators are installed, elevators are subjected to group management and control. The group management and control apparatus has a variety of functions and the most basic function is to improve a transportation efficiency. A specific function for improving the transportation efficiency is roughly classified into the following two types.

(1) Hall call allocation function (2) Car distribution control function

The hall call allocation function is to determine an optimum car for allocation when a hall call occurs in a hall. Also, during morning rush time, a plurality of cars are allocated at a lobby floor, and the car distribution control function is to allocate and forward the car regardless of the presence/absence of hall call occurrence.

Once, there was mainly used a system in which, when assuming that the respective elevators are allocated to the above hall calls, a group management performance such as a waiting time is evaluated by using a certain evaluation expression to determine the response car. Also, in the recent years, an artificial intelligence (AI) technology or the like is introduced into the group management and control in which the group management and control is conducted using a large number of rule groups. However, most of these rule groups are fixed and a part of rule groups may be subjected to parameter change by learning.

Also, in the recent years, as disclosed in, for example, JP-A-6-156893, there has been proposed a method in which a simulation function is incorporated in the group management and control apparatus, and the group management performance in the case of using a constant control system is subjected to simulation. However, even in this method, it is only possible to conduct simulation in which the parameter contained in the hall call allocation evaluation expression is changed, and the valid/invalid changing of many rule groups used for the group management or changing the combination thereof is not realized. This is because if simulation is conducted for all these cases, enormous computation time is required, thereby being incapable of being incorporated into the practical product.

The present invention has been made to solve the above-described problem, and an object of the present invention is to provide an elevator group management and control apparatus which is capable of always using an optimum rule group to implement group management and control.

DISCLOSURE OF THE INVENTION

According to the present invention, there is provided an elevator group management and control apparatus that manages and controls a plurality of elevators as one group, the elevator group management and control apparatus comprising: traffic demand detecting means for detecting the traffic demands of a plurality of elevators; traffic demand predicting means for predicting the traffic demand of the near future on the basis of the detected traffic demand; predicted traffic pattern discriminating means for discriminating the traffic pattern of the near future in accordance with the predicted result of the traffic demand; rule group candidate generating means for automatically generating a plurality of candidates from the group management and control rule groups to be applied in the near future on the basis of the traffic pattern which has been at least predicted and discriminated; rule group evaluating and selecting means for evaluating and selecting the candidate of the respective rule groups which have been generated; and operation control means for performing control by using the selected rule group.

Also, the rule group evaluating and selecting means predicts and evaluates the group management performance through simulation with respect to the predicted traffic demand in the case where the candidates of the respective rule groups are applied.

Further, the rule group candidate generating means picks up a number of rule groups from predetermined basic rule groups or makes various combinations of rule groups whose parameters have been changed on the basis of the discrimination result of the predicted traffic pattern discriminating means to automatically generate a plurality of candidates of the group management and control rule groups.

Still further, the rule group candidate generating means includes as standard rule groups corresponding to the predicted traffic pattern at least more than one of a fixed rule group which is always applied to a specific traffic pattern, a variable rule group which is not applied depending on a traffic circumstance, and a parameter rule group with a parameter value, and generates the candidates of the respective rule groups by combining the valid/invalid of the respective variable rules of the variable rule group and the changed parameter values of the respective parameter rules of the parameter rule group.

Yet still further, the rule group candidate generating means judges whether or not the traffic pattern has changed on the basis of the discrimination result of the predicted traffic pattern discriminating means, and generates the rule group candidate with respect to the parameter value of the parameter rule which is set to the standard value or to values in the vicinity of the standard value if the traffic pattern has changed, and with respect to the parameter value of the parameter rule which is set to the value previously set by the optimum rule group and to values in the vicinity of that value if the traffic pattern has not changed.

BRIEF DESCRIPTION OF THE DRAWINGS

FIG. 4 is an explanatory diagram showing an example of the rule group;

BEST MODE FOR CARRYING OUT THE INVENTION

Hereinafter, an embodiment of the present invention will be described with reference to the accompanying drawings.

Figure 1:
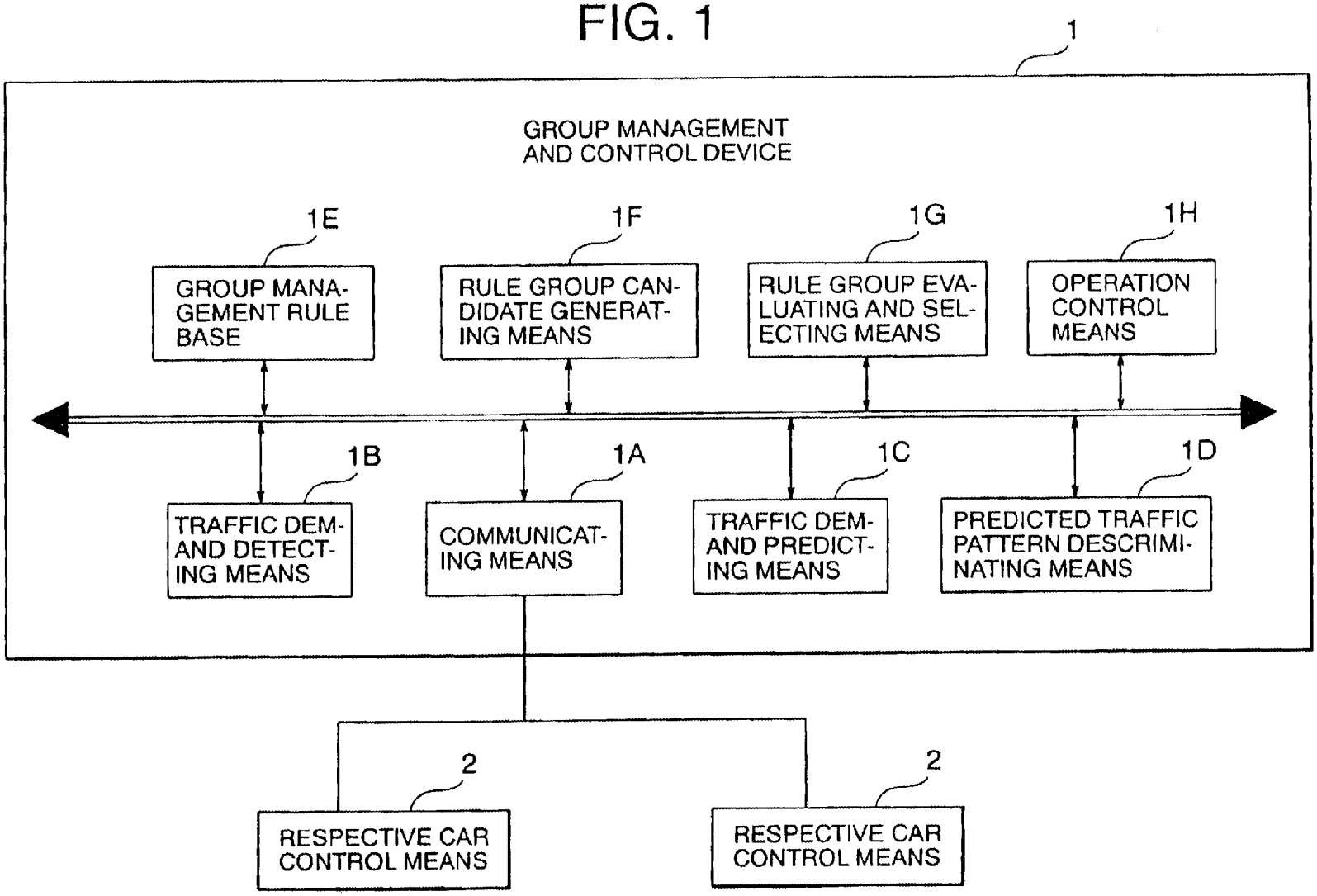
FIG. 1 is a block diagram showing the entire structural example of an elevator group management and control apparatus in accordance with the present invention.

FIG. 1 is a block diagram showing the entire structural example of an elevator group management and control apparatus in accordance with the present invention.

Referring to FIG. 1, reference numeral 1 denotes a group management and control apparatus for effectively managing and controlling a plurality of cars; 2 is the respective car control apparatuss. In FIG. 1, for simplification of the drawing, only two car control apparatuss are shown, but normally 2 to 8 cars are subjected to group management.

The group management and control apparatus 1 shown in FIG. 1 includes the following respective means of 1A to 1H, and those respective means is made up of software on a microcomputer.

In other words, the group management and control apparatus 1 includes a communication means 1A for communicating with the respective car control apparatuss 2; a traffic demand detecting means 1B for constatantly monitoring the traffic demands of a plurality of elevators which occurs within a building to periodically statistically process the traffic demands; a traffic demand predicting means 1C for predicting the traffic demand that will occur in the near future on the basis of the detected result of the traffic demand detecting means 1B; a predicted traffic pattern discriminating means 1D for discriminating the traffic pattern of the traffic demand that will occur in the near future on the basis of the predict ed result of the traffic demand predicting means 1C; a group management rule base 1E for storing a rule group necessary for the group management and control; a rule group candidate generating means 1F for automatically generating a plurality of candidates of the rule groups to be applied on the basis of the dicrimination result of the predicted traffic pattern discriminating means; a rule evaluating and selecting means 1G for evaluating the rule group candidate generated by said rule group candidate generating means 1F to select the rule group to be applied; and an operation control means 1H for controlling the entire operation of the elevators by applying the rule group selected by the rule group evaluating and selecting means 1G.

Next, the operation of this embodiment will be described with reference to FIG. 2.

Figure 2:
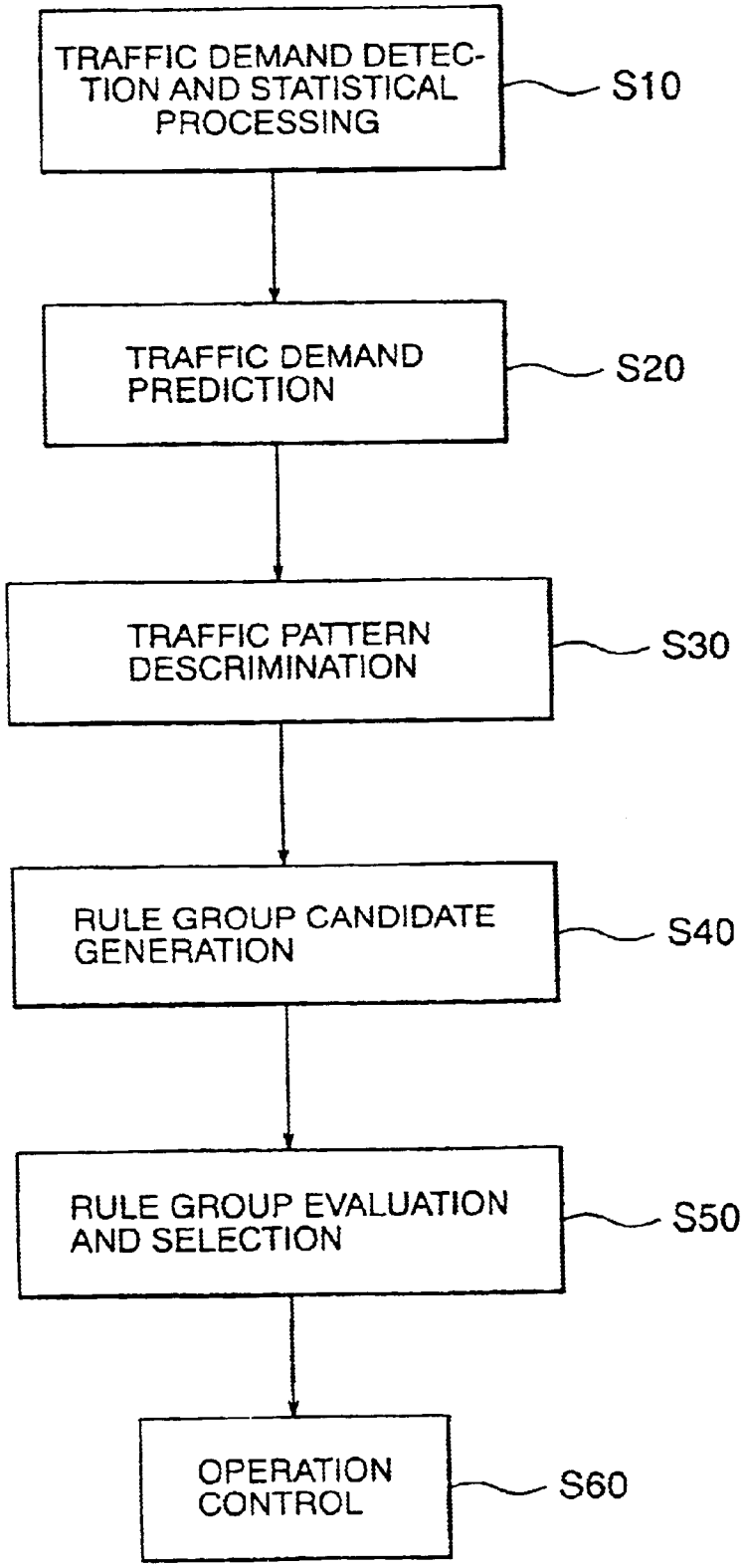
FIG. 2 is a flowchart showing the outline of the operation in accordance with an embodiment of the present invention.

FIG. 2 is a flowchart showing the outline of the operation in accordance with an embodiment of the present invention.

First, in step S10, data from the respective car control apparatuss 2 which pertains to the traffic demand represented by the number of passengers getting on and off at each floor is constantly monitored through the communication means 1A, and those traffic demand data is statistically processed periodically, for example, every 1 minute or 5 minutes. This procedure is implemented by the traffic demand detecting means 1B.

Then, in step S20, the prediction of the traffic demand in the near future, for example, for five minutes from now on is conducted by the traffic demand predicting means 1C based on the statistically processed data pertaining to the traffic demand in step S10. Some methods are proposed for this prediction of the traffic demand. For example, there is a method in which the traffic demand in the same time band as that of the past (yesterday) is recorded by a learning function, and the traffic demand is predicted through, for example, the following expression.

$$P(n)=\alpha\times P(n-1)+(1-\alpha)\times T(n-1)$$

Wherein P(n) is a predicted value of today, P(n−1) is a predicted value of yesterday, T(n−1) is an actual value of the traffic demand of yesterday, and $\alpha$ is a weight.

Also, as a means for predicting the traffic demand, there is a means for predicting the traffic demand by using the time series of today. For example, several past data is recorded, for example, as a unit of 1 minute or 5 minutes, and the traffic demand is predicted through the following expression.

$$P(t)=at3+bt2+ct+d$$

Wherein t is the present time, and a, b, c and d are parameters.

In the above expression, the values of the respective parameters may be determined by using the least square.

In addition, there has been proposed a method in which the above-described method using the learning and the prediction using the time series data are used in combination. There may be conceived other methods of predicting the traffic demand, but they may be appropriately set in accordance with the calculating time by a microcomputer and a memory capacity.

In a succeeding step S30, the traffic demand data predicted in step S20 is subjected to traffic pattern discrimination by the predicted traffic pattern discriminating means 1D. The pattern discrimination is performed by, for example, the following methods.

First, several basic traffic patterns and representative traffic demand data corresponding to the respective traffic patterns are set in advance. Then, a square error between the traffic demand data predicted in step S20 and the above respective representative traffic demand data is computed. Then, the traffic pattern the square error of which is minimum is selected.

Also, there has been proposed a method of using a neutral net (hereinafter referred to as "NN") as the method of discriminating the traffic pattern. The representative traffic demand data corresponding to the above respective traffic patterns is set in advance or extracted from the actual data and then recorded. The NN is structured to conduct learning so that the representative traffic demand data is inputted to NN, and the corresponding traffic pattern is outputted. With this operation, when arbitrary traffic demand data is inputted as the general property of NN, NN outputs the traffic pattern.

There may be conceived other various methods of discriminating the traffic pattern, however, since there have been proposed various method already, their detailed description will be omitted here.

Then, in step S40, several candidates of the rule groups to be applied by the rule group candidate generating means 1F are generated on the basis of the calculated result up to step S30. The details of the procedure will be described later.

In step S50, the rule group evaluating and selecting means 1G evaluates the respective rule group candidates generated in step S40 and then selects the best rule group.

As the method for evaluating respective rule group, conducting the simulation is the most accurate. Specifically, the group management performance in the case of applying the respective rule group candidates corresponding to the traffic demand predicted in step S20 is predicted through simulation. That is, a waiting time, a service completion time, the number of fully-occupied cars or the like in the case of applying the respective rule groups are predicted through simulation. Then, the simulation result is comprehensively evaluated through, for example, the following expression, and the rule group is selected whose comprehensive evaluation value is the best.

(Comprehensive evaluation value of the rule group e)=w1×(the waiting time evaluation value of the rule group e)+w2×(the number of fully occupied cars evaluation value of the rule group e)+w3×(service completion time evaluation time of the rule value e)+w4×(the energy saving evaluation value of the rule group e)

wherein w1 to w4 are weights.

In step S60, the operation control means 1H performs the operation control by using the rule group selected in step S50.

Since the procedure of step S10 to S50 is implemented periodihall cally and regularly every 5 minutes, the operation control according to the rule group selected in step S50 is implemented up to a succeeding period.

The above description was given of the rough procedure of the operation in this embodiment.

Next, step S40 in FIG. 2, that is, the rule group candidate generating procedure by the rule group candidate generating means 1F will be described in detail with reference to FIGS. 3 to 6.

Figure 5:
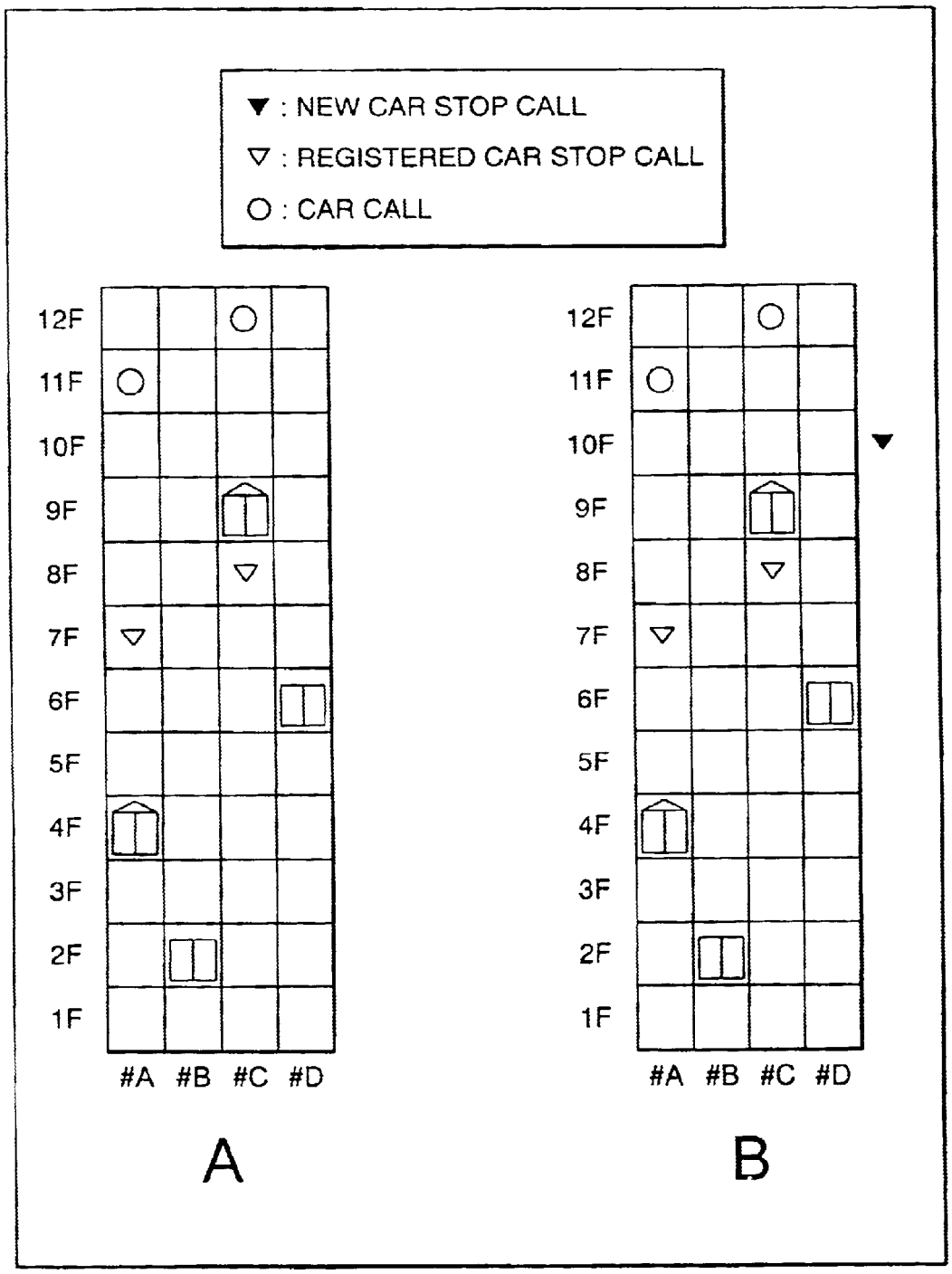
FIG. 5 is an explanatory diagram showing an application example of a rule.
Figure 6:
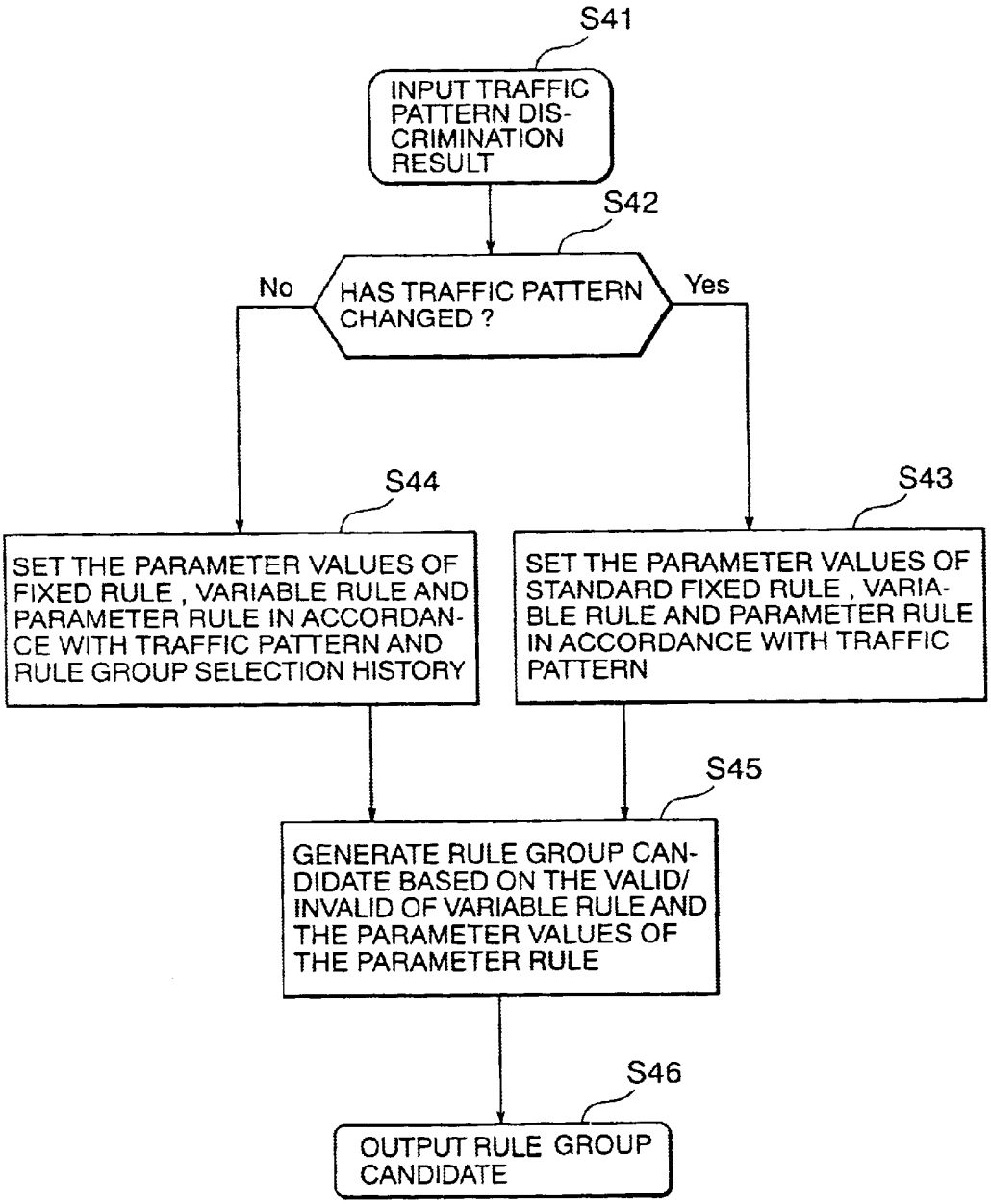
FIG. 6 is a flowchart showing the outline of a rule group candidate generation procedure.

FIG. 3 is an explanatory diagram for explaining a concept of a rule group candidate generation; FIG. 4 is an explanatory diagram showing an example of the rule group; FIG. 5 is an explanatory diagram showing an application example of a rule; and FIG. 6 is a flowchart showing the outline of a rule group candidate generation procedure.

The concept of the rule group candidate generation by the rule group candidate generating means 1F in accordance with the present invention picks up a number of rule groups from predetermined basic rule groups or makes various combinations of rule groups whose parameters have been changed to automatically generate a plurality of group management and control rule groups.

Figure 3A:
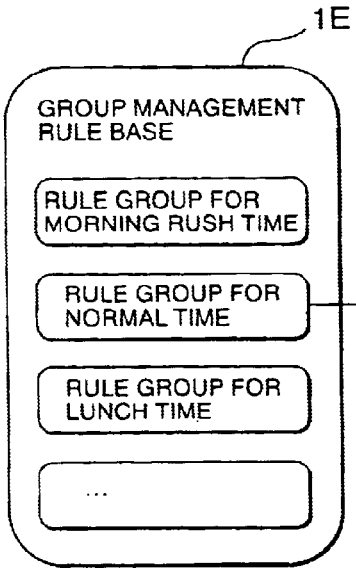
FIG. 3 is an explanatory diagram for explaining a concept of a rule group candidate generation.
Figure 3B:
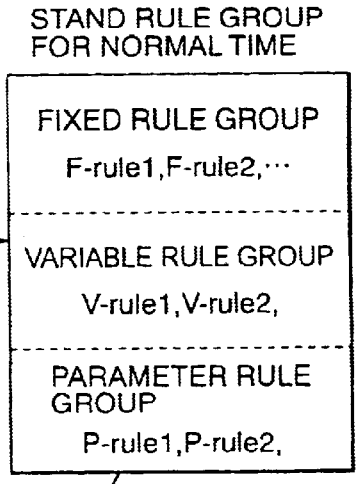
Figure 3C:
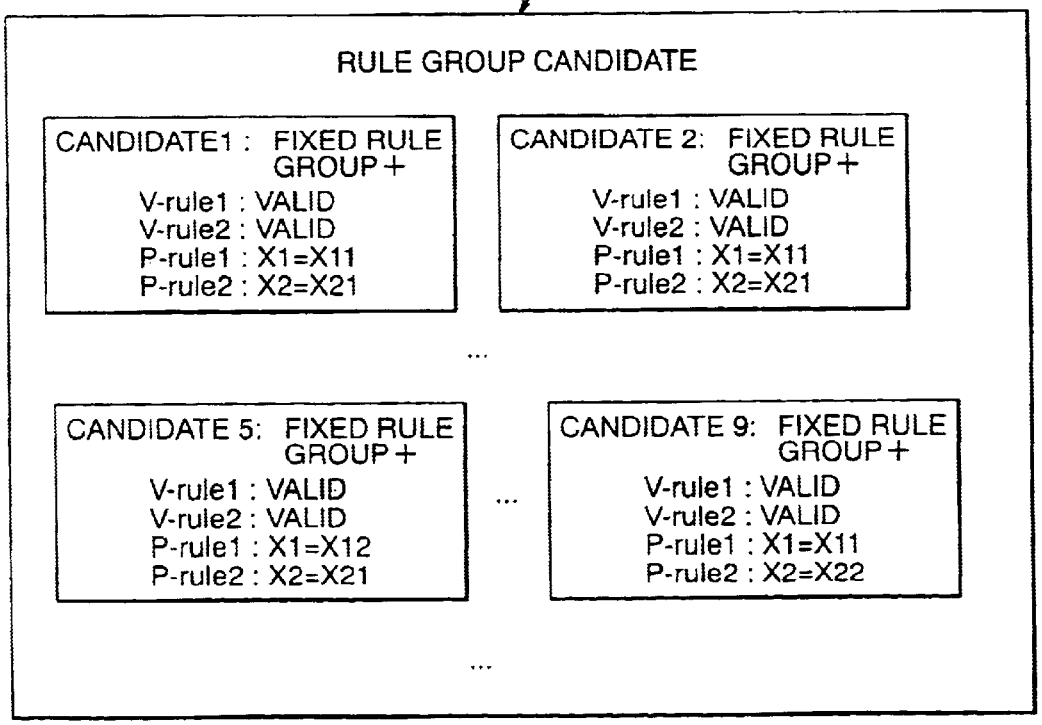

Therefore, if it is judged, for example, in step S30 of FIG. 2 that the predicted traffic demand is that of the normal time, the standard rule group for the normal time is first extracted from the group management rule base 1E shown in FIG. 3A as shown in FIG. 3B. Then, the validity/invalidity of the respective rules among the standard rule group for the normal time shown in FIG. 3B is combined with the changed parameter value of the rule including the parameter value to prepare the rule group candidate shown in FIG. 3C.

In this example, the number of standard rule groups and the number of parameter values which can be obtained by the respective parameter rules is not small. Therefore, it is not practical to generate the rule group candidate with respect to all of combinations. In particular, conducting evaluation of all possible combinations of rules through simulation in step S50 inevitably causes a problem regarding the computation time even if a CPU high in performance is used.

For that reason, here a method is adopted in which the standard rule group is classified into three kinds consisting of a fixed rule group, a variable rule group and a parameter rule group in advance.

Then, the candidates of the respective rule groups including at least more than one of the fixed rule group, the variable rule group and the parameter rule group as the standard rule group corresponding to the predicted traffic pattern is generated by the combination of the validity/invalidity of the respective variable rules of the variable rule group with the changed parameter values of the respective parameter rules of the parameter rule group.

In this example, the fixed rule group is directed to a rule group which is very likely to be effective with respect to a specific traffic pattern and always applied. The variable rule group is directed to a rule group which is often effective but waiting time may be shorter when it is not applied, depending on the traffic circumstance. Also, the parameter rule group is directed to a rule group including the parameter value.

The application example of this concept and the rule will be described with reference to FIGS. 4 and 5.

A case in which it is judged that the traffic pattern discriminated in step S30 of FIG. 2 is that of the normal time is exemplified.

As an example of the rule applied in the normal time, consider the following respective rules as shown in FIG. 4.

Fixed rule: dumpling operation prevention rule, comprehensive evaluation rule

Variable rule: main floor waiting rule

Parameter rule: long waiting prevention rule

The dumpling operation refers to a state in which, for example, cars which are close to each other and move in the same direction stop at the same floor, or outrun each other to respond to a call at the next stop, so that a plurality of cars are running close to each other without being apart. Consequently, since the cars are allocated unevenly, the service performance as the elevator group is lowered. Thus, the dumpling operation prevention rule shown in FIG. 4 is directed to a rule in which if there are cars that move in the same direction, no other cars are allocated.

Also, the long waiting prevention is that passengers waiting time is one of service indexes and the car is allocated to a hall call of a passenger having long predicted waiting time in priority, to thereby improve the service, and the long waiting prevention rule as shown in FIG. 4 is directed to a rule that does not implement the allocation to a car that suffers from long waiting if allocated.

In the example shown in FIG. 5, four cars are provided. A stop floor of the building is the twelfth floor, and 1F is the main floor.

FIG. 5A shows a state in which a hall call at a hall has been already allocated. In this example, in the case where the main floor waiting rule is applied, one car (car #B) is allocated at 1F. In general, since a floor which is most crowded is the main floor, there are many cases where this rule is effective. However, if this rule is applied, since one car is always allocated at the main floor, the service for upper floors is generally degraded. Therefore, there is a case where the waiting time may be shorter when this rule is not applied depending on the traffic state. Accordingly, in this example, this rule is rendered a variable rule, and its validity is examined through simulation.

In FIG. 5B, a new hall call occurs in 10F (DOWN). If the main floor waiting rule is not effective in FIG. 5B, no car is allocated to 1F. Also, the dumpling operation prevention rule which is the fixed rule is applied, and two cars, #A and #C, are selected as the allocation candidates in response to a hall call from 10F (DOWN). In general, when the dumpling operation occurs, the operation efficiency is degraded, and therefore in this example, this rule is always applied as the fixed rule. Also, the comprehensive evaluation rule is to select a car to be finally allocated in the case where there are a plurality of allocation candidates, and this is also the fixed rule.

Then, in the case where the long waiting prevention rule is applied as the parameter rule, the allocation candidate is determined in accordance with a value of the parameter T of the long waiting prevention rule, and the predicted waiting times of the hall call #A (7FDOWN) and the hall call #C (8FDOWN). The predicted waiting time is normally calculated by the following expression.

(Predicted waiting time in the case where a certain car is allocated)=(predicted time for the car to arrive at a hall call generating floor)+(elapsed time since the hall call has occured)

The computation procedure of the above expression and the arrival predicted time within the expression are well known.

In this example, assuming that, for example, the predicted waiting time in the case where the new hall call (10FDOWN) is allocated to #A is 10FDOWN: 24 seconds, 7FDOWN: 50 seconds, 8FDOWN: 24 seconds, and the predicted waiting time in the case where the new hall call is allocated to #C is 10FDOWN: 20 seconds, 8FDOWN: 44 seconds, 7FDOWN: 40 seconds, the allocation candidate becomes as follows with reference to the parameter rule shown in FIG. 4.

In the case of T=30 seconds, #C is an allocated car. (longest and shortest waiting)

In the case of T=45 seconds, #C is an allocated car.

In the case of T=60 seconds, #A and #C are allocation candidates, and the allocated cars are selected through the comprehensive evaluation expression.

(If the comprehensive evaluation expression is a total value of predicted waiting times, #A is selected)

As described above, there is a case where the allocated car may be different even under the same traffic circumstance, depending on the parameter value of the parameter rule.

In this example, there are many kinds of the parameter values of the parameter rule for some rule, and therefore it is difficult to examine all of the kinds of parameter values. Therefore, this example takes the following method. This procedure will be described with reference to a flowchart shown in FIG. 6.

First, in step S41, if a traffic pattern discriminated result is inputted, it is judged in step S42 whether the discriminated result is changed, or not.

In this example, a procedure of from the traffic pattern discrimination to the rule group selection is periodihall cally executed such as every 5 minutes. In this step, it is judged whether the traffic pattern has remained the same such as (before 5 minutes: normal time) to (present time: normal time), or has changed such as (before 5 minutes: morning rush time) to (present time: normal time).

In the case where the traffic pattern has changed (in case of Yes in step S42), the parameter value of the parameter rulethat is set to a standard value and the parameter value that is set to values in the vicinity of the standard value are to be examined in step S43. For example, in the case where the standard value is 60 seconds in the long waiting prevention rule shown in FIG. 4, what set the parameter values to 45 seconds and 75 seconds are to be examined.

Also, in the case where the traffic pattern has not changed (in case of No in step S42), the value previously selected in the optimum rule group and values in the vicinity of that value are to be examined in step S44. For example, in the case where a value selected in the long waiting prevention rule shown in FIG. 4 is 45 seconds, what are set to 30 seconds and 60 seconds are to be examined.

Then, the rule group candidate is prepared by combination of the validity/invalidity of the respective variable rule and the values that can be taken by the parameter values of the respective parameter rules in step S45, and then outputted in step S46. In the example shown in FIG. 4, there are provided one variable rule and one parameter rule. Thus, in total, 2×3=6 possible combinations are evaluated and examined, two being valid/invalid of the variable rule and three kinds of parameter values for the parameter rule.

With the above operation, even if all of cases are not examined, at least the parameter value of the parameter rule can be appropriately changed.

As described above, according to the present invention, in the elevator group management and control apparatus for managing and controlling a plurality of elevators as one group, the traffic demand of the plurality of elevators which occurs in a building is detected, the traffic demand in the near future is predicted on the basis of the detected traffic demand, and the traffic pattern in the near future is discriminated based on the predicted result of the traffic demand, a plurality of candidates of the group management and control rule group which are to be applied in the near future are automatically generated on the basis of at lease the predicted and discriminated traffic pattern, the candidates of the respective rule groups generated are evaluated and selected, and control is effected by using the selected rule group. Therefore, it is advantageous in that the group management and control can be implemented by always employing the appropriate rule group, and the transportation efficiency can be improved.

Also, since the group management performance when applying the candidates of the respective rule groups corresponding to the predicted traffic demand is predicted and evaluated through simulation, the performance when the respective rule groups are applied can be accurately predicted and grasped, thereby being capable of selecting the appropriate rule group.

Further, since, on the basis of the predicted traffic pattern discrimination result, a number of rules are picked up from predetermined basic rule groups or various combinations of rule groups, whose parameters have been changed, are made to automatically generate a plurality of candidates of the group management and control rule groups, the rule group candidates to be evaluated can be narrowed to some degree, and the rule group selection computation can be implemented within an practical time.

Still further, the candidates of the respective rule groups including at least more than one of the fixed rule group, the variable rule group and the parameter rule group as the standard rule group corresponding to the predicted traffic pattern are generated by the combination of the validity/invalidity of the respective variable rules of the variable rule group with the changed parameter values of the respective parameter rules of the parameter rule group. Therefore, an appropriate rule group candidate can be selected corresponding to varying traffic circumstances, thereby being capable of reducing the rule group selection computation.

In addition, it is judged whether or not the traffic pattern has changed on the basis of the discriminated result of the predicted traffic pattern discriminating means, and in the case where the traffic pattern has changed, the parameter value of the parameter rule that is ser to a standard value and the parameter value that is set to values in the vicinity of the standard value are to be examined. Also, in the case where the traffic pattern has not changed, the value previously selected in the optimum rule group and values in the vicinity of that value are to be examined. As a result, the parameter value corresponding to the change in the traffic pattern can be selected.

INDUSTRIAL APPLICABILITY

According to the present invention, in the elevator group management and control apparatus for managing and controlling a plurality of elevators as one group, the traffic demand of the plurality of elevators which occurs in a building is detected, the traffic demand in the near future is predicted on the basis of the detected traffic demand, and the traffic pattern in the near future is discriminated in accordance with the predicted result of the traffic demand, a plurality of candidates of the group management and control rule group which are to be applied in the near future are automatically generated on the basis of the traffic pattern which has been at least predicted and discriminated, the candidates of the respective rule groups generated are evaluated and selected, and control is effected by using the selected rule group. Therefore, it is advantageous in that the group management and control can be implemented by always employing an appropriate rule group, and transportation efficiency can be improved.

What is claimed is:

1. An elevator group management and control apparatus that manages and controls a plurality of elevators as one group, the elevator group management and control apparatus comprising:

traffic demand detecting means for detecting traffic demands of a plurality of elevators;

traffic demand predicting means for predicting a traffic demand of the near future based on the traffic demands detected;

predicted traffic pattern discriminating means for discriminating a traffic pattern of the near future in accordance with the traffic demand predicted;

rule group candidate generating means for automatically generating a plurality of candidates from group management and control rule groups to be applied in the near future based on the traffic pattern which has been predicted and discriminated;

rule group evaluating and selecting means for evaluating and selecting one candidate from the respective rule groups which have been generated; and operation control means for controlling the plurality of elevators using the rule group selected.

2. The elevator group management and control apparatus as claimed in claim 1, wherein said rule group evaluation selecting means predicts and evaluates the group management performance through simulation with respect to the traffic demand predicted when the candidates of the respective rule groups are applied.

3. The elevator group management and control apparatus as claimed in claim 1, wherein said rule group candidate generating means picks up a number of rule groups from predetermined basic rule groups or makes various combinations of rule groups whose parameters have been changed, based on discrimination by said predicted traffic pattern discriminating means to automatically generate a plurality of candidates from the group management and control rule groups.

4. The elevator group management and control apparatus as claimed in claim 3, wherein said rule group candidate generating means includes, as a standard rule corresponding to the traffic pattern predicted, at least two fixed rule groups always applied to a specific traffic pattern, a variable rule group which is not applied depending on a traffic circumstance, and a parameter rule group with a parameter value, and generates the candidates of the respective rule groups by combining validity/invalidity of the respective variable rules of the variable rule group and the parameter values of the respective parameter rules of the parameter rule group that have been changed.

5. The elevator group management and control apparatus as claimed in claim 4, wherein said rule group candidate generating means determines whether the traffic pattern has changed based on the discrimination by said predicted traffic pattern discrimination means, and generates one rule group candidate with respect to the parameter value of the parameter rule which is set to a standard value or to values near a standard value if the traffic pattern has been changed and, with respect to the parameter value of the parameter rule which is set to a value previously set by the optimum rule group or to values in the vicinity of that value, if the traffic pattern has not changed.

* * * * *